US005540774A

United States Patent [19]

Smitherman

[11] Patent Number: 5,540,774

[45] Date of Patent: Jul. 30, 1996

[54] DRIP PROOF DISPENSING METHOD AND NOZZLE ASSEMBLY FOR DISPENSING VISCOUS MATERIALS

[75] Inventor: John P. Smitherman, Salinas, Calif.

[73] Assignee: Illinois Tool Works Inc., Glenview, Ill.

[21] Appl. No.: 387,639

[22] Filed: Feb. 13, 1995

Related U.S. Application Data

[63] Continuation of Ser. No. 231,867, Apr. 25, 1994, abandoned, which is a continuation of Ser. No. 962,666, Oct. 19, 1992, abandoned.

[51] Int. Cl.[6] ..... B05C 5/00

[52] U.S. Cl. ..... 118/315; 118/325; 118/411; 156/578

[58] Field of Search ..... 118/411, 666, 118/667, 313, 314, 315, 325, 255; 156/244.11, 578, 359

[56] References Cited

U.S. PATENT DOCUMENTS

| | | | |
|---|---|---|---|
| 3,052,211 | 9/1962 | Shirley et al. | 118/315 |
| 3,890,926 | 6/1975 | Teed | 118/325 |
| 4,157,149 | 6/1979 | Moen | 118/411 X |
| 4,329,897 | 7/1983 | Herrington | 156/578 X |
| 4,426,239 | 1/1984 | Upmeier | 156/244.11 X |
| 4,562,088 | 12/1985 | Navarro | 118/667 X |
| 4,618,384 | 10/1986 | Sabee | 156/244.11 X |
| 4,667,879 | 5/1987 | Muller | 118/411 X |
| 4,687,137 | 8/1987 | Boger et al. | 118/411 X |
| 4,721,252 | 1/1988 | Colton | 239/424.5 |
| 4,844,004 | 7/1989 | Hadzimihalis et al. | 118/315 |
| 4,890,573 | 1/1990 | Zaber | 118/667 |
| 4,932,353 | 6/1990 | Kawata et al. | 118/666 X |
| 5,016,812 | 5/1991 | Pedigrew | 229/132 |
| 5,024,709 | 6/1991 | Faulkner, III et al. | 156/69 |
| 5,105,760 | 4/1992 | Takahashi et al. | 118/411 X |
| 5,136,972 | 8/1992 | Naka et al. | 118/411 X |

FOREIGN PATENT DOCUMENTS

| | | | |
|---|---|---|---|
| 0839598 | 6/1981 | U.S.S.R. | 118/667 |

*Primary Examiner*—James Engel
*Attorney, Agent, or Firm*—Schwartz & Weinrieb

[57] ABSTRACT

An apparatus for applying a viscous material upon a portion of a substrate positioned substantially within a first plane proximate the apparatus during relative movement between the apparatus and the substrate including a nozzle member for selectively dispensing the material in a predetermined pattern and with a predetermined frequency and for eliminating dispensing, dripping and stringing of any residual material after dispensing is stopped, the nozzle including at least one material flow path therethrough having a first end forming a nozzle outlet facing the substrate and a second end in operable communication with a material supply, at least a portion of the material flow path proximate the first nozzle outlet end being substantially linear and positioned at an acute angle with respect to the first plane to eliminate material dripping and stringing.

28 Claims, 3 Drawing Sheets

FIG. 3
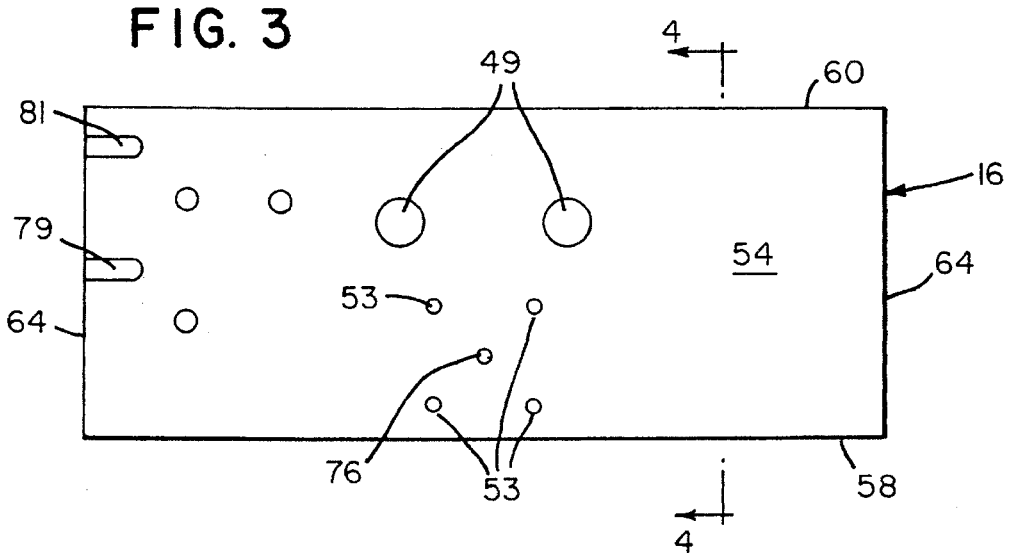
FIG. 7
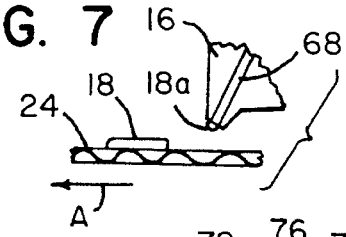
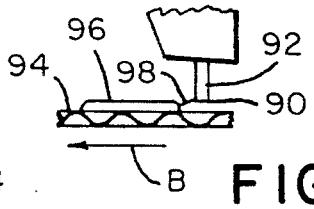
FIG. 6
PRIOR ART
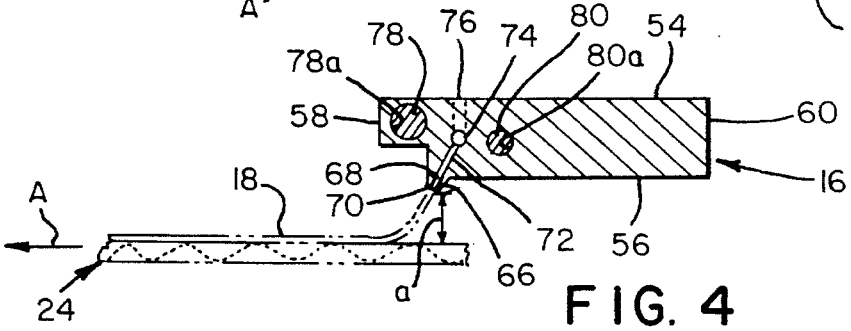
FIG. 4
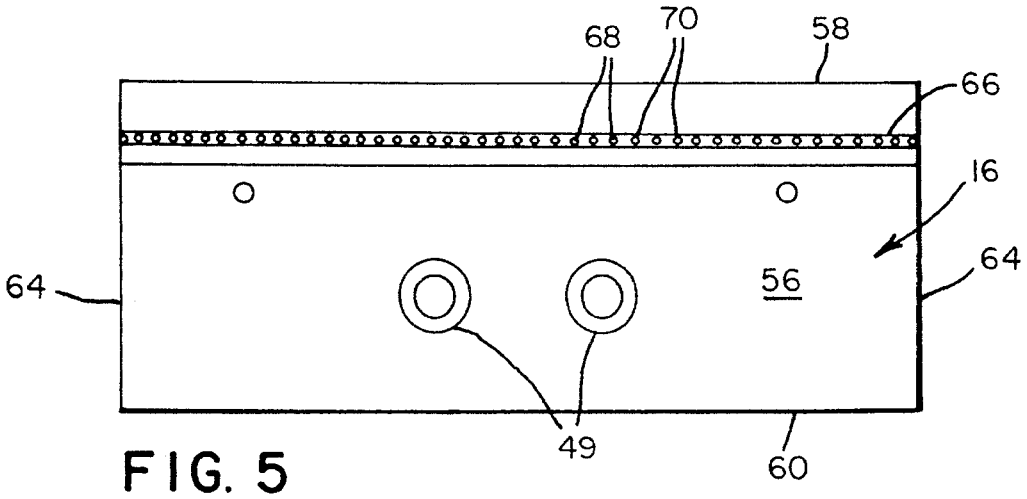
FIG. 5

DRIP PROOF DISPENSING METHOD AND NOZZLE ASSEMBLY FOR DISPENSING VISCOUS MATERIALS

This application is a continuation of application Ser. No. 08/231867, filed Apr. 25, 1994 now abandoned which, in turn, is a continuation of application Ser. No. 07/962666 filed Oct. 19, 1992 now abandoned.

BACKGROUND OF THE INVENTION

1. Field of the Invention

This invention relates generally to material dispensing nozzles, and more particularly to a method and nozzle assembly for dispensing a viscous material, such as an adhesive, onto a moving substrate in a precise predetermined pattern and with a predetermined frequency, which eliminates any residual material from being dispensed, which can be readily interchanged with another nozzle assembly having a different pattern and, if a hot melt adhesive is utilized, which provides controlled heating of the adhesive throughout the nozzle assembly.

2. Description of the Related Art

Nozzle assemblies are frequently utilized to dispense a viscous adhesive onto containers, such as end flaps of cardboard boxes, prior to closing and filling the container with a desired material. These nozzle assemblies typically include a material flow path through the nozzle which extends between a material reservoir or supply line to a nozzle outlet or dispensing tip and are actuated by a mechanism to selectively dispense the adhesive with a predetermined frequency.

An example of such a nozzle assembly is illustrated in U.S. Pat. No. 4,844,004 which discloses a method and apparatus for applying narrow, closely spaced beads of viscous liquid, such as a hot melt adhesive, to a substrate. The apparatus includes a manifold block in operable communication with a plurality of dispensing guns and a nozzle assembly formed by a shim defining vertical slots therethrough. In order to obtain sharp cutoff of liquid flow, the shim must be sufficiently thin, the width of the slot must be sufficiently narrow, and the length of the slot must be sufficiently long such that the flow resistance is sufficient to cut off the flow of liquid from the exit orifices when the dispensing guns are cut off. Such a structure, however, is extremely complex and requires a multiplicity of components which increases costs and changeover time, thereby reducing flexibility. Additionally, this structure relies on a baffle or restrictor type distribution of the liquid requiring precise tolerances and very small dimensions which are difficult to obtain and maintain. Furthermore, despite the allegation of material cutoff, this structure frequently exhibits "stringing" of material, especially with high viscosity adhesives.

In order to provide container sealing for the packaging of granular products such as rice or powders such as soap, dried milk, sugar or the like, a "siftproof" or "infestation resistant" seal must be provided, especially if a separate liner is not utilized. This type of seal requires accurate positioning and flow of adhesive to eliminate any openings and is typically is considered acceptable if the sealed carton can hold water without leaking.

An example of such a siftproof seal is illustrated in U.S. Pat. No. 5,024,709 which discloses a contact-free method of forming sift-proof seals utilizing an adhesive strip pattern for closure of a container having a plurality of folded flaps.

Adhesive dispensing is accomplished by a plurality of vertical nozzles, one of which is substantially is illustrated in FIG. 6 of the present application.

Those nozzles, however, do not provide precise cutoff of the adhesive thereby causing excess accumulation of the adhesive about the nozzle outlets and dripping and stringing of the adhesive into undesired locations on the container. Additionally, since the adhesive is typically heated, the nozzles are positioned at a distance from the heater member which requires the entire head to be overheated in order to maintain the desired temperature of the adhesive. Any overheating of the adhesive can cause degradation of the adhesive and long term contamination. Additionally, such a nozzle is limited by the viscosity of the adhesive which is typically approximately 1,000 centipoise (cp.), but is expected to increase in the future, especially with adhesives for use with coated cartons.

It therefore would be desirable to provide a method and nozzle assembly for dispensing a viscous adhesive, especially a heated viscous adhesive, onto a moving substrate in a precise predetermined pattern and with a predetermined frequency which eliminates any residual adhesive from being dispensed as well as any dripping or stringing of the adhesive, which can readily be interchanged with another nozzle assembly having a different pattern, size or both, and which provides a heater and sensor therein for precise and accurate heating of the adhesive throughout the nozzle assembly.

SUMMARY OF THE INVENTION

The invention provides an apparatus for applying a viscous material upon a portion of a substrate positioned substantially within a first plane proximate the apparatus during relative movement between the apparatus and the substrate. The apparatus includes a nozzle member for selectively dispensing the material in a predetermined pattern and with a predetermined frequency, and for eliminating dispensing, dripping and stringing of any residual material after dispensing is stopped. The nozzle includes at least one material flow path therethrough having a first end forming a nozzle outlet facing the substrate and a second end in operable communication with a material supply. At least a portion of the material flow path proximate the first nozzle outlet end is substantially linear and positioned at an acute angle with respect to the first plane so as to eliminate material dripping and stringing.

BRIEF DESCRIPTION OF THE DRAWINGS

Various objects, features, and attendant advantages of the present invention will become more fully appreciated from the following detailed description when considered in connection with the accompanying drawings, in which like reference characters designate like or corresponding parts throughout the several views, and wherein:

FIG. 3 is a top plan view of a nozzle bar of the assembly of the invention;

FIG. 4 is a cross-sectional view of the nozzle bar of the invention, taken along line 4—4 of FIG. 3 and in the direction indicated generally, illustrating adhesive application to a substrate in dotted outline;

FIG. 5 is a bottom plan view of the nozzle bar of the invention illustrating the row of dispensing nozzles and two mounting apertures for fastening the nozzle bar to the remainder of the assembly;

FIG. 6 is an enlarged side elevational view of a PRIOR ART nozzle illustrating adhesive dispensing on a substrate and the undesirable stringing of adhesive;

FIG. 7 is an enlarged side elevational view of the nozzle of the present invention illustrating the precise adhesive cutoff.

DESCRIPTION OF THE PREFERRED EMBODIMENTS

Figure 1:
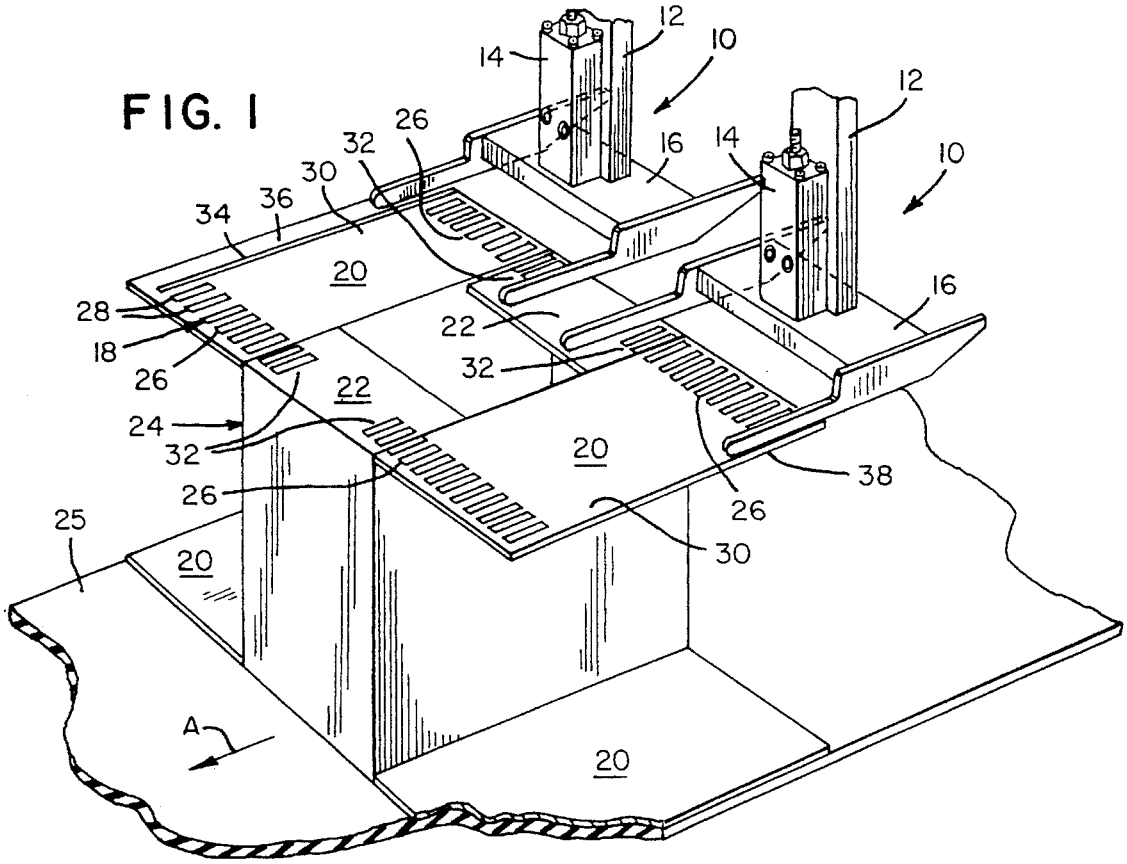
FIG. 1 is a perspective view illustrating two nozzle assemblies of the invention applying adhesive in a precise predetermined pattern to the end flaps of a container.
Figure 2:
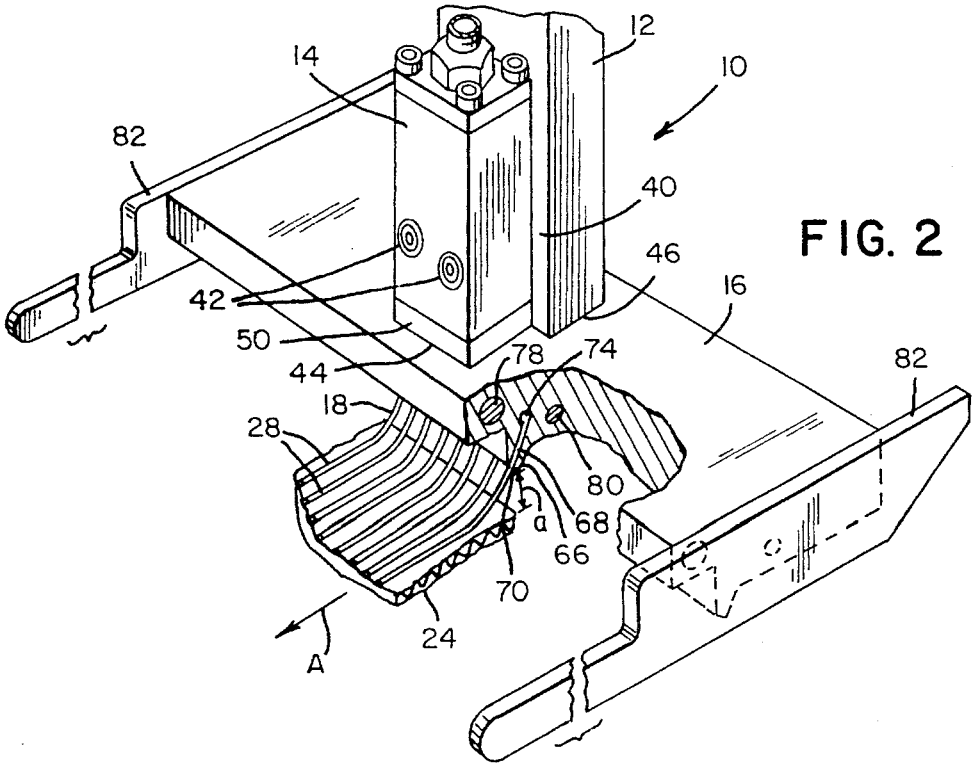
FIG. 2 is an enlarged perspective view, in partial section, of a nozzle assembly of the invention illustrating the adhesive application in detail.

Referring to FIGS. 1 and 2, the nozzle assembly of the invention is generally designated by reference numeral 10. The assembly 10 includes a mounting or service block 12, a modular valve 14 and a nozzle bar 16.

Briefly, in operation, as FIG. 1 illustrates, the assembly 10 is utilized to apply adhesive 18 in a precise predetermined pattern onto major end flaps 20 as well as minor end flaps 22 of a container 24, such as a cardboard box or the like. Preferably, two assemblies 10 are utilized to simultaneously apply adhesive to one end of the container 24 which is conveyed past the assemblies 10 in the direction indicated by arrow "A" such as on a conveyor belt 25 or similar conveying device.

It is to be understood, however, that the number of assemblies 10 per container 24 can vary and additional assemblies 10 can be positioned on the opposite end of the container 24 so as to simultaneously apply adhesive to both ends of the container 24. The assemblies 10 can also be designed for movement with respect to a moving or stationary container 24, if desired. After the adhesive is applied, the major and minor end flaps 20 and 22 are folded, preferably by another machine (not illustrated) operating in conjunction with the assembly 10, so as to seal the end of the container 24.

The predetermined pattern of adhesive 18 illustrated is selected for use in a sift-proof type of container, but can vary. Accordingly, the preferred pattern of adhesive 18 is provided by four sets 26 of adhesive 18, each set 26 including a plurality of closely spaced narrow rows or beads 28 of adhesive 18. Each row 28 is substantially of the same length and extends parallel to the longitudinal axis of the major end flaps 20.

Each set 26 of rows 28 essentially extends along the entire width of an inside surface 30 at both opposite longitudinal ends of each major end flap 20 and overlaps an outside portion 32 of each minor end flap 22 which is folded inward prior to passing the assemblies 10. Accordingly, when the container 24 is fully closed, the rows or beads 28 flow together to form an uninterrupted seal. To prevent material from leaking about the corners of the container 24, a double portion of adhesive 18 is provided at the contact area between the outside portions 32 of the minor end flaps 22 and the major end flaps 20 which corresponds to a corner of the sealed container 24.

Additionally, in order to provide a seal along the length of the major end flaps 20, one or more lines 34 of adhesive 18 are provided along one longitudinal side 36 of the major end flap 20 which is the last flap to be folded. The line 34 of adhesive 18 contacts an outside surface 38 of the opposite major end flap 20 and/or the outside portions 32 of the minor flaps 22 upon sealing of the container 24.

As FIGS. 2 and 4 illustrate, the desired portions of the container 24 that are to receive adhesive 18 pass through at least a portion of a plane positioned a predetermined distance "a" beneath the nozzle bar 16 and are conveyed in the direction of arrow "A". The distance "a" and speed between the container 24 and nozzle bar 16 can vary and typically depends upon the type of adhesive 18.

As FIGS. 1 and 2 illustrate, the service block 12 mounts the assembly 10 to a support or mounting structure (not illustrated) and serves as a connecting point for various inputs (not illustrated) to the valve 14 and nozzle bar 16. Preferably, the service block 12 is mounted on one end to the nozzle bar 16 and is mounted on its opposite end to an arm assembly (not illustrated) which positions one or more assemblies 10 for application of the adhesive 18 to the container 24 and can provide for movement and/or adjustability of the assemblies 10.

Figure 8:
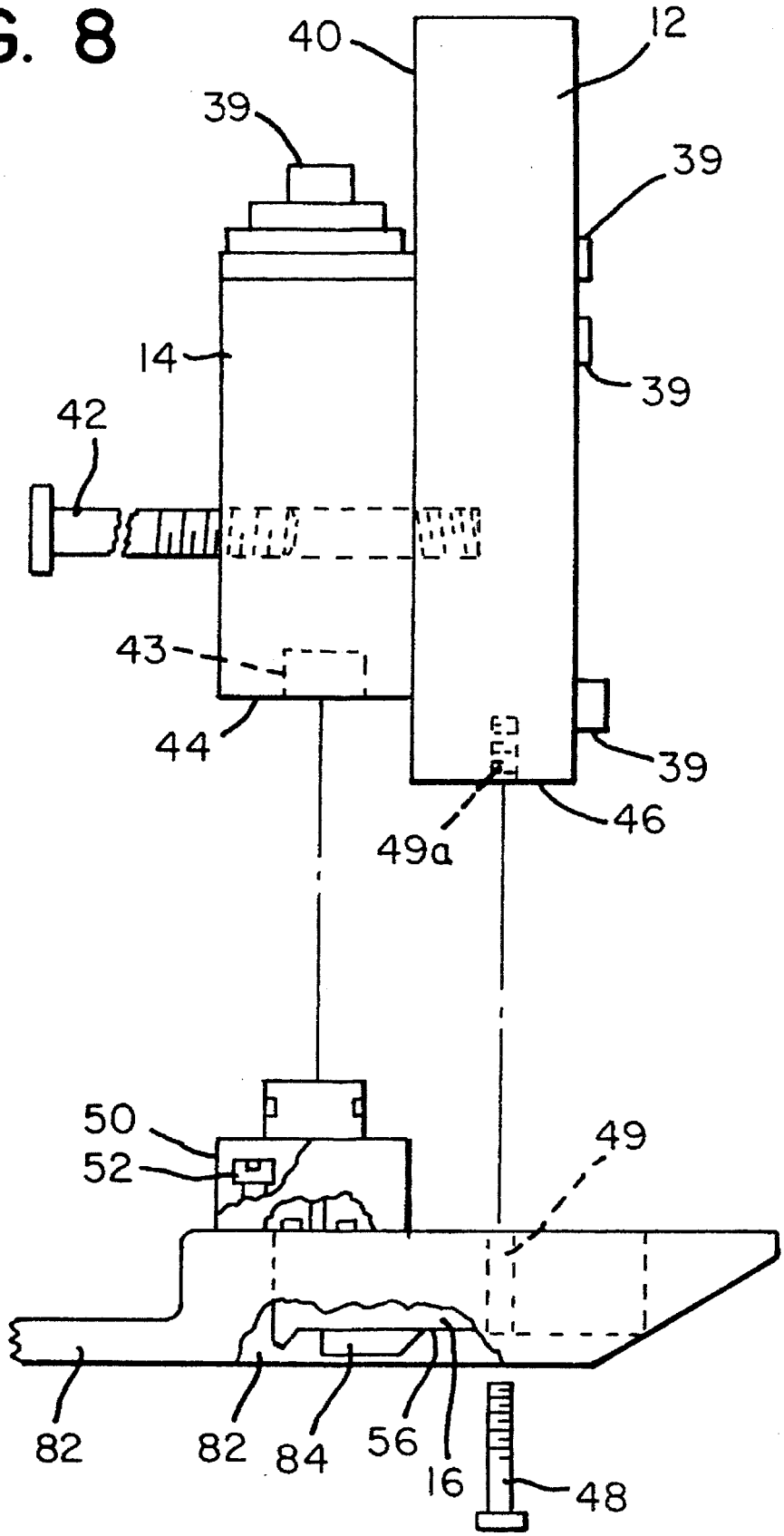
FIG. 8 is an exploded side elevational view in partial section of a nozzle assembly of the invention.

As FIG. 8 illustrates, in order to connect inputs to the service block 12, a desired number of couplings 39 are provided on the rear of the service block 12 and near the top of the valve 14. The input lines, however, can be connected in any manner including through the top and interior of the service block 12, if desired. The inputs provide electrical and/or air power for operation and control of the valve 14 as well as a flow line for adhesive 18.

The adhesive 18 is preferably a hot melt type of adhesive which is heated to a predetermined temperature before being conveyed to the service block 12. The exact temperature can vary, depending upon the type of adhesive 18 utilized and the desired application. As will be explained in detail below, the nozzle bar 16 includes a heat source and a temperature sensor close to the point of application of the adhesive 18 so as to pre-heat, monitor and maintain the desired temperature of the nozzle bar 16 and to maintain the temperature of the adhesive 18 during application.

The valve 14 is connected to a front surface 40 of the service block 12 by bolts 42 and can be a solenoid type valve or gun or any other type of material dispensing device. As described below, the valve 14 supplies adhesive 18 to the nozzle bar 16 by way of an adhesive outlet 43 on a bottom surface 44 of the valve 14.

The nozzle bar 16 is formed in one-piece and is connected to a bottom surface 46 of the service block 12 by two bolts 48, one each extending through countersunk apertures 49 formed through the nozzle bar 16 and connected to threaded apertures **49*a* in the service block 12. To provide adhesive 18 to the nozzle bar 16 from the valve 14, the nozzle bar 16 preferably includes a seat member 50 which is connected to the nozzle bar 16 by four bolts 52 positioned about the seat member 50 which engage threaded apertures 53, illustrated in FIG. 3, formed in the nozzle bar 16. The seat member 50 provides a quick-connect type of seal upon snapping engagement with the adhesive outlet 43 of the valve 14**.

To provide rapid interchangeability with other nozzle assemblies (not illustrated) having different sizes and/or adhesive patterns, the nozzle bar 16 and seat member 50 are readily connected to the service block 12 and valve 14 by only two bolts 48. It is to be understood, however, that the particular connections between the nozzle bar 16 and the service block 12 and valve 14 can vary, so long as the quick connection and desired adhesive flow are provided.

As FIGS. 3–5 illustrate, the nozzle bar 16 is a substantially rectangular die member formed from a single piece of material, preferably metal, and includes a top surface 54, bottom surface 56, front side 58, rear side 60 and two opposite ends 64. In order to extrude adhesive 18 in a precise position, the bottom surface 56 includes an outwardly extending elongate nozzle portion 66 which spans the length of the nozzle bar 16 proximate the front side 58.

In order to provide the individual rows 28 of adhesive 18, the nozzle portion 66 includes a plurality of parallel channels 68 formed therein. Each channel 68 includes a first outlet end 70 facing the direction of travel "A" of the container 24, and a second inlet end 72 and is positioned at a predetermined angle with respect to the bottom surface 56 of the nozzle bar 16. The nozzle bar 16 includes forty-six channels 68 along its length, but the number can vary between twenty and eighty and may be outside that range if desired. The angle of each channel 68 is an acute angle with respect to a vertical plane so as to provide the nozzle bar 16 with the ability to dispense precise rows 28 of adhesive 18 without any dripping or stringing of adhesive, especially with extremely viscous adhesives.

As FIG. 4 illustrates, the preferred angle between the channels 68 and the bottom surface 56 is approximately sixty degrees, but can vary. Additionally, the outlet end 70 is squared off and perpendicular to the channels 68 so as to form an angle of approximately thirty degrees with respect to the direction indicated by arrow "A". The channels 68 have a preferred diameter of approximately 0.018 inches (0.46 mm) ±0.005 inches (0.13 mm) and are spaced apart 0.100 inches (2.54 mm).

As FIG. 4 illustrates, a longitudinal bore 74 is provided substantially through the nozzle bar 16, is closed at opposite ends and is in communication along its length with the second inlet end 72 of each channel 68. The bore 74 is provided with adhesive 18 through a central passageway 76 formed through the nozzle bar 16 and extending between the bore 74 and the top surface 54 for communication with the valve 14 through the seat member 50.

In order to pre-heat and maintain the nozzle bar 16 at a desired temperature, a heater member 78 is provided within a longitudinal aperture **78*a* formed in the nozzle bar 16 proximate the bore 74 and channels 68. Preferably, the heater member 78 is an electrical resistance type of heater which extends along the length of the nozzle bar 16 and provides for mounting of an electrical lead through a slotted aperture 79 formed in the top surface 54 of the nozzle bar 16**.

In order to monitor the temperature, a sensor 80 is positioned within a longitudinal aperture **80*a* of the nozzle bar 16 proximate the bore 74 and channels 68. The sensor 80 is preferably connected to a temperature controller (not illustrated) which is mounted to the sensor 80 through a slotted aperture 81 formed in the top surface 54 of the nozzle bar 16 and regulates the temperature of the nozzle bar 16. Due to the close proximity of the sensor 80 and heater member 78 to the channels 68 and bore 74, the temperature of the adhesive 18** is also regulated to ensure accurate application.

All of the electrical and control equipment can be located remote from the assembly 10 and connected to the nozzle bar 16 in any desired manner. Alternatively, some of this equipment can be mounted to the top surface 54 of the nozzle bar 16 (not illustrated) and can be connected by leads to the heater 78 and sensor 80 through access apertures 79 and 81, respectively, in the nozzle bar 16 with appropriate connections to external power and any additional control and monitoring devices.

As FIG. 8 illustrates, in order to assist in holding down and guiding the major and minor flaps 20 and 22 of the container 24 as they pass the assemblies 10, each opposite end 64 of the nozzle bar 16 can include a guide member 82 connected thereto by bolts (not illustrated). In order to assist in moving the container beneath the nozzle bar 16, a skid or wear plate 84 is connected to the bottom surface 56 of the nozzle bar 16.

In operation, as FIG. 2 illustrates, a container 24 is passed beneath an assembly 10 in the direction of arrow "A" at a distance "a" from the outlets 70 of the nozzle portion 66. Adhesive 18 is fed through the valve 14 and the seat member 50, through the passageway 76 and into the bore 74 and finally through the channels 68. As the adhesive 18 exits the first outlet end 70 of each channel 68, the rows 28 of adhesive are formed and applied to the container 24.

The acute angle between the channels 68 and the bottom surface 56 substantially corresponds to the angle formed between the channels 68 and the container 24. It is this angle combined with the squared off perpendicular outlet end 70, the viscosity of the adhesive as well as principles of fluid and solid mechanics which provide the unique and rather unexpected results of the present invention.

Specifically, as FIG. 6 illustrates, prior art nozzles typically position outlet ends 90 of dispensing nozzles 92 perpendicular to a surface 94 to which adhesive 96 is to be applied. Accordingly, when dispensing has ceased and the surface 94 continues moving in the direction indicated by arrow "B", the adhesive 96 tends to provide strings 98, especially with viscous adhesives. These strings 98 eventually break and fall onto the surface 94 in undesired areas. Improperly applied adhesive is especially important in sift-proof containers since they typically do not have a liner and the container material can leak out or be contaminated by the adhesive 96.

In the present invention, as FIGS. 4 and 7 illustrate, the channels 68 are positioned at an angle to take advantage of fluid and solid mechanics principles and the direction of travel between the assembly 10 and the container 24 so as to prevent stringing out and excess unwanted accumulation of adhesive. Since the adhesive 18 is a viscous fluid or thermoplastic, it experiences a resistance force as it is conveyed through the assembly 10 and particularly the channels 68. The more viscous the adhesive 18, however, the more it behaves like a plastic which, upon being subjected to a shear or tensile force, exhibits deformation and eventually fracture or failure. Thus, the adhesive 18 has characteristics of both a fluid and a plastic or solid which are relied upon in the present invention to prevent dripping and stringing.

After dispensing of adhesive 18 is stopped, the resistance between the adhesive 18 and the channels 68 prevents any further adhesive flow out of the outlet ends 70 of the channels 68. The slight amount of excess adhesive remaining between the outlet ends 70 and the container 24 is subject to tension from the moving container 24 in the direction of arrow "A" and against the resistance provided by the channels 68. The excess adhesive initially undergoes some deformation but, due to the angle of the channels 68, tends to shear or fracture across its initially circular cross-section rather than deform further and provide stringing. Accordingly, after fracturing, the excess adhesive substantially "snaps" back to form a bead **18*a* of adhesive 18 on the outlet end 70 of each channel 68, the bead 18*a* being carried away or dispensed in subsequent dispensing cycles. Some of the excess adhesive may also snap back to the substrate 24 so as to slightly extend a row 28 of the adhesive 18, but such accumulation is inconsequential and in any event does not provide the undesirable stringing of adhesive 18. Thus, the entire assembly 10 operates much cleaner than existing adhesive dispensing assemblies so as to prevent jamming and dripping or stringing of adhesive 18** in improper areas.

Theoretically, the angle of the channels 68 provides a resistance force to the adhesive 18 having a component in the same direction "A" as the tensile force provided by the moving container 24. This promotes shearing or fracture of the adhesive 18 rather than stringing, as in the prior art nozzles 92 of FIG. 6 which are perpendicular to a tensile force in direction "B". Although the angle of the channels 68 preferably is sixty degrees, it can vary to provide different results and to accommodate different adhesives and applications.

As FIG. 8 illustrates, in order to change the nozzle bar 16, the two bolts 48 are removed and the nozzle bar 16, along with the seat 50 and guides 82, are removed in one piece from the service block 12 and valve 14. Thereafter, a different nozzle bar complete with a seat and guides (not illustrated) can readily be connected by the bolts 48 to provide a different pattern of adhesive 18.

Modifications and variations of the present invention are possible in light of the above teachings. It therefore is to be understood that within the scope of the appended claims the invention may be practiced otherwise than as specifically described.

What is claimed and desired to be secured by letters patent is:

1. Apparatus for depositing a viscous material upon a portion of a substrate which is positioned within a plane proximate said apparatus during relative movement between said apparatus and said substrate in a predetermined direction, comprising:

viscous material supply means for supplying said viscous material to be deposited upon said substrate;

a solid nozzle bar having substantially the configuration of a rectangular solid with the longitudinal extent thereof disposed transversely with respect to said predetermined direction of relative movement between said apparatus and said substrate; an upper surface; and a lower surface disposed parallel to said substrate;

a longitudinal bore defined transversely within said solid nozzle bar and fluidically connected to said viscous material supply means through said upper surface of said solid nozzle bar so as to receive a supply of said viscous material from said viscous material supply means;

a plurality of channels defined within said solid nozzle bar along said longitudinal extent thereof, fluidically connected at first end portions thereof to said longitudinal bore so as to receive said viscous material from said longitudinal bore, and defining material dispensing outlets, facing said substrate for dispensing said material onto said substrate, at second opposite end portions thereof which are disposed at an acute angle with respect to said lower surface of said solid nozzle bar and said plane of said substrate so as to prevent dripping and stringing of said viscous material when deposition of said viscous material upon said substrate is terminated;

longitudinal heating means disposed transversely within said solid nozzle bar at a position adjacent to and upon one side of said longitudinal bore and said plurality of channels, as considered in said predetermined direction of relative movement, for heating said solid nozzle bar and said viscous material to a predetermined temperature; and longitudinal sensor means disposed transversely within said solid nozzle bar at a position adjacent to and upon an opposite side of said longitudinal bore and said plurality of channels, as considered in said predetermined direction of relative movement, and operatively connected to said longitudinal heating means, for sensing the temperature of said solid nozzle bar and controlling said longitudinal heating means so that the temperature of said solid nozzle bar and said viscous material is regulated to said predetermined temperature.

2. The apparatus as defined in claim 1 wherein said apparatus includes mounting means for maintaining said apparatus in a stationary position with respect to a moving substrate.

3. The apparatus as defined in claim 1 wherein said nozzle bar includes said plurality of viscous material flow channels for dispensing the material in a plurality of predetermined patterns.

4. The apparatus as defined in claim 3 wherein said plurality of channels are positioned substantially parallel to each other.

5. The apparatus as defined in claim 1, wherein:

said nozzle bar is formed as a one-piece structure and is readily interchangeable with similar nozzle bars having different dispensing patterns.

6. Apparatus as set forth in claim 1, wherein:

the number of said plurality of channels defined within said nozzle bar may be within the range of twenty to eighty.

7. Apparatus as set forth in claim 6, wherein:

said number of channels defined within said nozzle bar is preferably forty-six.

8. Apparatus as set forth in claim 1, wherein:

said acute angle is approximately sixty degrees.

9. Apparatus as set forth in claim 1, wherein:

said second outlet end of each one of said viscous material flow channels is disposed perpendicular to its respective channel defining its respective flow path within said nozzle bar such that said second outlet end of each one of said flow path channels is disposed at an angle of thirty degrees with respect to said plane of said substrate.

10. Apparatus as set forth in claim 1, wherein:

said plurality of channels are transversely spaced with respect to each other along a direction perpendicular to said predetermined direction by means of a distance of approximately 0.100 inches, and each one of said plurality of channels has a diameter of approximately 0.018 inches.

11. Apparatus as set forth in claim 1, wherein:

said heating means comprises a resistance type heater disposed parallel to said transversely disposed bore operatively interconnecting said viscous material flow channels to said viscous supply means.

12. Apparatus as set forth in claim 11, wherein:

said heating means is disposed at a position which is forward of said transversely disposed longitudinal bore and within said solid nozzle bar as considered in said direction of relative movement between said apparatus and said substrate.

13. Apparatus as set forth in claim 1, wherein:

said viscous material comprises an adhesive;

said substrate comprises at least one flap of a carton to be sealed after said adhesive is applied to said at least one flap of said carton; and said nozzle bar comprises guide means for engaging said at least one flap of said carton so as to maintain said at least one flap in a predetermined position as said at least one flap of said carton passes said nozzle bar as said substrate moves relative to said apparatus along said predetermined direction.

14. Apparatus as set forth in claim 1, wherein:

said longitudinal sensor means is disposed parallel to said longitudinal heating means and said longitudinal bore, and is disposed within said solid nozzle bar at a position which is disposed rearward of said longitudinal bore as viewed in said direction of relative movement between said apparatus and said substrate.

15. A method of depositing a viscous material onto a substrate without any dripping or stringing of said material after dispensing of said viscous material has been terminated, comprising the steps of:

providing a viscous material supply means for supplying said viscous material to be deposited upon said substrate;

providing a nozzle means including a solid nozzle bar having substantially the configuration of a rectangular solid with the longitudinal extent thereof disposed transversely with respect to a predetermined direction of relative movement between said nozzle means and said substrate; said nozzle bar further comprising an upper surface, and a lower surface disposed parallel to said substrate;

providing a longitudinal bore within said solid nozzle bar such that said longitudinal bore is disposed transversely within said solid nozzle bar and fluidically connected to said viscous material supply means through said upper surface of said solid nozzle bar so as to receive a supply of said viscous material from said viscous material supply means;

providing a plurality of channels within said solid nozzle bar such that said plurality of channels are disposed along said longitudinal extent of said solid nozzle bar and are fluidically connected at first end portions thereof to said longitudinal bore so as to receive said viscous material from said longitudinal bore, while defining material dispensing outlets, facing said substrate for dispensing said viscous material onto said substrate when said substrate is moved relative to said nozzle bar within a plane proximate said nozzle bar and along said predetermined direction, at second opposite end portions thereof which are disposed at an acute angle with respect to said lower surface of said solid nozzle bar and said plane within which said substrate is being moved relative to said nozzle bar so as to prevent dripping and stringing of said viscous material when deposition of said viscous material upon said substrate is terminated;

providing longitudinal heating means oriented transversely within said nozzle bar at a position adjacent to and upon one side of said longitudinal bore and said plurality of channels, as considered in said predetermined direction of relative movement, for heating said nozzle bar and said viscous material to a predetermined temperature;

providing longitudinal sensor means oriented transversely within said nozzle bar at a position adjacent to and upon an opposite side of said longitudinal bore and said plurality of channels and operatively connected to said heating means so as to respectively sense the temperature of said nozzle bar and control said heating means so that the temperature of said nozzle bar and said viscous material can be regulated to said predetermined temperature;

moving said substrate relative to said nozzle bar and within said plane so as to permit said viscous material to be dispensed from said nozzle bar and deposited onto said substrate;

activating said nozzle means so as to dispense said viscous material therefrom and deposit said viscous material onto said substrate;

deactivating said nozzle means so as to terminate the dispensing of said viscous material; and continuing said relative movement of said substrate with respect to said nozzle bar after deactivating said nozzle means so as to fracture said viscous material between said substrate and said nozzle outlets of said nozzle bar.

16. The method as set forth in claim 15, wherein:

said acute angle is approximately sixty degrees.

17. The method as set forth in claim 15, wherein:

said second outlet end of each one of said viscous material flow channels is disposed perpendicular to its respective flow path within said nozzle bar such that said second outlet end of each one of said flow channels is disposed at an angle of thirty degrees with respect to said plane of said substrate.

18. The method as set forth in claim 15, wherein:

said heating means comprises a resistance type heater.

19. The method as set forth in claim 15, wherein:

said longitudinal heating means is disposed parallel to said longitudinal bore and is disposed at a position within said solid nozzle bar which is disposed forward of said longitudinal bore as viewed in said direction of relative movement between said nozzle means and said substrate.

20. The method as set forth in claim 15, wherein:

said longitudinal sensor means is disposed parallel to said longitudinal bore and said longitudinal heating means, and is disposed at a position within said nozzle bar which is rearward of said longitudinal bore as viewed in said direction of relative movement between said nozzle means and said substrate.

21. Apparatus for depositing a viscous material upon a portion of a substrate which is positioned within a plane proximate said apparatus and during relative movement between said apparatus and said substrate in a predetermined direction, comprising:

viscous material supply means for supplying a viscous material, having a predetermined viscosity value, to be deposited onto a substrate;

a solid nozzle bar having a substantially rectangular solid configuration and a longitudinal extent which is disposed transversely with respect to said predetermined direction of relative movement between said apparatus and said substrate; an upper surface; and a lower surface disposed parallel to said substrate;

a longitudinal bore defined transversely within said solid nozzle bar and fluidically connected to said viscous material supply means through said upper surface of said solid nozzle bar so as to receive a supply of said viscous material from said viscous material supply means;

a plurality of channels, each one having a predetermined diametrical extent, defined within said solid nozzle bar along said longitudinal extent thereof; fluidically connected at first end portions thereof to said longitudinal bore, and defining material dispensing outlets, disposed toward said substrate so as to dispense said viscous material onto said substrate, at second opposite end portions thereof which are disposed at a predetermined acute angle with respect to said lower surface of said solid nozzle bar and said plane of said substrate such that upon cessation of dispensing of said viscous material from said material dispensing outlets of said plurality of channels, resistance defined between said viscous material, having said predetermined viscosity value, and said channels of said solid nozzle bar, having said predetermined diametrical extent, prevents any additional flow of said viscous material out from said material dispensing outlets, and said movement of said substrate relative to said material dispensing outlets, as well as said predetermined acute angle of said material dispensing outlets with respect to said plane of said substrate, causes said viscous material extending between said material dispensing outlets and said substrate to be subjected to tensile and shearing forces which induce definitive fracture within said viscous material so as to prevent additional dripping and stringing of said viscous material;

longitudinal heating means disposed transversely within said solid nozzle bar at a position adjacent to and upon one side of said longitudinal bore and said plurality of channels for heating said solid nozzle bar and said viscous material to a predetermined temperature; and longitudinal sensor means disposed transversely within said solid nozzle bar at a position adjacent to and upon an opposite side of said longitudinal bore and said plurality of channels, as considered in said predetermined direction of relative movement, and operatively connected to said longitudinal heating means, for sensing the temperature of said solid nozzle bar and controlling said longitudinal heating means so that the temperature of said solid nozzle bar and said viscous material is regulated to said predetermined temperature.

22. Apparatus as set forth in claim 21, wherein:

said predetermined acute angle of said material dispensing outlets is approximately sixty degrees (60°).

23. Apparatus as set forth in claim 21, wherein:

said material dispensing outlets are squared off and disposed substantially perpendicular to the longitudinal extent of each one of said plurality of channels, respectively.

24. Apparatus as set forth in claim 21, wherein:

each one of said plurality of channels has a diametrical extent of approximately 0.018 inches (0.018").

25. A method of depositing a viscous material onto a substrate without any dripping or stringing of said material after dispensing of said viscous material has been terminated, comprising the steps of:

providing a viscous material supply means for supplying a viscous material, having a predetermined viscosity value, to be deposited onto a substrate;

providing a solid nozzle bar having a substantially rectangular solid configuration and a longitudinal extent which is disposed transversely with respect to a predetermined direction of relative movement between said solid nozzle bar and said substrate; an upper surface; and a lower surface disposed parallel to said substrate;

providing a longitudinal bore within said solid nozzle bar such that said longitudinal bore is disposed transversely within said solid nozzle bar and fluidically connected to said viscous material supply means through said upper surface of said solid nozzle bar so as to receive a supply of said viscous material from said viscous material supply means;

providing a plurality of channels, each one having a predetermined diametrical extent, within said solid nozzle bar and along said longitudinal extent thereof such that each one of said plurality of channels is fluidically connected at first end portions thereof to said longitudinal bore so as to receive said viscous material from said longitudinal bore, and wherein further, material dispensing outlets, disposed toward said substrate so as to dispense said viscous material onto said substrate as said substrate is moved relative to said solid nozzle bar within a plane proximate said solid nozzle bar and along said predetermined direction of relative movement, are defined at second opposite end portions of said channels such that said outlets are disposed at a predetermined acute angle with respect to said lower surface of said solid nozzle bar and said plane within which said substrate is moved relative to said nozzle bar so as to prevent dripping and stringing of said viscous material when deposition of said viscous material upon said substrate has been terminated;

providing longitudinal heating means oriented transversely within said solid nozzle bar at a position adjacent to and upon one side of said longitudinal bore and said plurality of channels, as considered in said predetermined direction of relative movement, for heating said solid nozzle bar and said viscous material to a predetermined temperature;

providing longitudinal sensor means oriented transversely within said solid nozzle bar at a position adjacent to and upon an opposite side of said longitudinal bore and said plurality of channels, as considered in said predetermined direction of relative movement, and operatively connected to said heating means so as to sense the temperature of said solid nozzle bar and control said heating means so that the temperature of said solid nozzle bar and said viscous material can be regulated to said predetermined temperature;

moving said substrate relative to said solid nozzle bar and within said plane so as to permit said viscous material to be dispensed from said nozzle bar and deposited onto said substrate;

activating said solid nozzle bar so as to dispense said viscous material outwardly from said material dispensing outlets of said channels of said nozzle bar and thereby deposit said viscous material onto said substrate;

deactivating said solid nozzle bar so as to terminate said dispensing of said viscous material from said material dispensing outlets whereby resistance, defined between said viscous material, having said predetermined viscosity value, and said channels of said solid nozzle bar, having said predetermined diametrical extent, prevents any additional flow of said viscous material out from said material dispensing outlets; and continuing said relative movement of said substrate with respect to said solid nozzle bar after said deactivation of said solid nozzle bar such that said movement of said substrate relative to said material dispensing outlets of said solid nozzle bar, as well as said predetermined acute angle of said material dispensing outlets with respect to said plane of said substrate, causes said viscous material extending between said material dispensing outlets and said substrate to be subjected to tensile and shearing forces which induce definitive fracture within said viscous material so as to prevent additional dripping and stringing of said viscous material.

26. The method as set forth in claim 25, wherein:

said predetermined acute angle of said material dispensing outlets is approximately sixty degrees (60°).

27. The method as set forth in claim 25, wherein:

said material dispensing outlets are squared off and disposed substantially perpendicular to the longitudinal extent of each one of said plurality of channels, respectively.

28. The method as set forth in claim 25, wherein:

each one of said plurality of channels has a diametrical extent of approximately 0.018 inches (0.018").

* * * * *